US005163890A

United States Patent [19]

Perry, Jr.

[11] Patent Number: 5,163,890

[45] Date of Patent: * Nov. 17, 1992

[54] ADDUCTOR CONTRACTION EXERCISE APPARATUS AND METHOD

[76] Inventor: Leroy R. Perry, Jr., 1301 E. Rubio St., Altadena, Calif. 91101

[ * ] Notice: The portion of the term of this patent subsequent to Aug. 4, 2009 has been disclaimed.

[21] Appl. No.: 723,579

[22] Filed: Jul. 1, 1991

Related U.S. Application Data

[63] Continuation-in-part of Ser. No. 706,648, Jun. 3, 1991.

[51] Int. Cl.[5] ..... A63B 26/00

[52] U.S. Cl. ..... 482/142; 482/91; 482/907

[58] Field of Search ..... 482/144, 140, 131, 142, 482/72, 145, 91, 907; 128/68, 69, 73, 75, 57; 272/144, 145, 900

[56] References Cited

U.S. PATENT DOCUMENTS

| | | | |
|---|---|---|---|
| 418,257 | 12/1889 | Whitely | 272/136 |
| 623,698 | 4/1899 | Beckh | 272/75 |
| 1,693,810 | 12/1928 | Daniels et al. | 128/68 |
| 2,046,653 | 7/1936 | Petcoff | 272/57 |
| 2,176,342 | 3/1937 | Hoppe | 482/144 |
| 2,498,006 | 2/1950 | Ridill | 278/189 R |
| 3,286,708 | 11/1966 | Gartner | 482/144 |
| 3,618,942 | 11/1971 | Bates | 272/136 |
| 3,652,085 | 3/1972 | Cole | 272/134 |
| 3,677,543 | 7/1972 | Richardson | 273/273 |
| 3,685,511 | 8/1972 | Alvarez | 128/57 |
| 3,722,507 | 3/1973 | Krause | 128/68 |
| 3,807,730 | 4/1974 | Dalton et al. | 272/135 |
| 3,870,317 | 3/1975 | Wilson | 273/188 R |
| 4,019,734 | 4/1977 | Lee et al. | 272/137 |
| 4,207,879 | 6/1980 | Safadago et al. | 128/70 |
| 4,247,096 | 1/1981 | Schmitt | 272/71 |
| 4,292,962 | 10/1981 | Krause | 128/68 |
| 4,304,401 | 12/1981 | Goodman | 272/137 |
| 4,328,964 | 5/1982 | Walls | 272/136 |
| 4,340,218 | 7/1982 | Wilkinson | 272/136 |
| 4,411,423 | 10/1983 | Estwanik, III | 272/117 |
| 4,461,287 | 7/1984 | Takahashi | 272/57 R |
| 4,488,719 | 12/1984 | Brown | 482/72 |
| 4,494,533 | 1/1985 | Sgroi et al. | 212/75 |
| 4,503,845 | 3/1985 | Licciardi | 128/75 |
| 4,534,555 | 8/1985 | McGowen | 272/145 |
| 4,544,155 | 10/1985 | Wallenbrock et al. | 272/136 |
| 4,546,967 | 11/1985 | Kocala | 482/145 |
| 4,566,693 | 1/1986 | Seidentop et al. | 272/144 |
| 4,609,193 | 9/1986 | Paris et al. | 272/145 |
| 4,703,929 | 11/1987 | Reed | 272/144 |
| 4,753,438 | 6/1988 | Paris et al. | 272/144 |
| 4,864,804 | 12/1989 | Fenwick | 272/145 |
| 4,893,813 | 1/1990 | Murray et al. | 272/145 |
| 5,002,043 | 3/1991 | George | 128/25 R |

OTHER PUBLICATIONS

From: *What the World Needs Now* p. 69 3-position Incliner *Author* Steven M. Johnson 1984.

*Primary Examiner*—Richard J. Apley
*Assistant Examiner*—Jerome Donnelly
*Attorney, Agent, or Firm*—William W. Haefliger

[57] ABSTRACT

A body supporting and flexing apparatus, comprising primary support structure, including a primary platform to support a user's legs, and to allow pivoting of the user's trunk about a generally horizontal axis as the user relatively bends his body and his legs; and auxiliary support structure connected to the primary support structure, and projecting relatively away from the primary platform at adjusted level and to an extent to support at least one of the following:

i) the user's trunk between the head and legs, ii) the user's legs between the feet and knee.

7 Claims, 3 Drawing Sheets

ADDUCTOR CONTRACTION EXERCISE APPARATUS AND METHOD

This application is a continuation-in-part of Ser. No. 706,648 filed Jun. 3, 1991.

BACKGROUND OF THE INVENTION

This invention relates generally to body exercise apparatus, and more particularly to improved apparatus providing for adductor contraction during relative bending, extending or flexing of the user's trunk and legs.

Many people suffer from internal organ weakness, inner pelvic muscular and ligament laxity, inner thigh and adductor, gracilis muscular weakness, weak abdominal musculature, spinal and lower back, and instability resulting from loss of symmetry of muscle development. There is need for apparatus providing a mean whereby those who suffer from the aforementioned can exercise biomechanically efficiently to strengthen the necessary muscle groups to ensure a strong, symmetrical development of the body with emphasis on adductor (inner thigh) and abdominal stability.

SUMMARY OF THE INVENTION

It is a major object of the invention to provide apparatus or equipment that is operable or usable in such manner as to meet the above need. Basically, the apparatus serves to distract or distend the user's spine to relieve pressure as at the sacroiliac region, in response to forward and downward flexing of the user's trunk relative to his or her legs or, and/or rearward and downward flexing of the user's legs relative to his or her trunk. In this regard, the apparatus aids in inducing adductor contraction (inner thigh contraction), which approximates the anterior aspect of the ilium while decreasing load on the sacroiliac joints posteriority. This procedure may be further facilitated by use of a medial inner thigh pad that positions the thigh or thighs, as the body and legs relatively flex. Such biomechanical action reduces sacroiliac compression, while maximizing reduction of stress on the lumbosacral joints. Adductor contraction also stimulates lower abdominal muscle contraction, thereby emphasizing inner pelvic muscular contraction and strengthening, which is accomplished through isokinetic exercise movement associated with the adductor and flexion movements. This controlled, biomechanical movement not only stretches the hamstring, gluteus maximus, erector spinal and associated posterior body musculature while decompressing the spine, but also strengthens the adductor, gracilis, abdominal, and inner pelvic musculature.

Those who suffer from tipped uteruses and bladders, prostate dysfunction or related diseases, or pathomechanical syndromes related to muscular instability and therefore internal organ pressure or compression in a vertical posture, as well as those patients with lower abdominal vascular, muscular, and neurological compression, can often benefit from exercise that produces a combined action of forward flexion and adductor contraction.

In some cases, stretching of the abdominal viscera may be helpful. In those cases, extension and even hyperextension may be accomplished with adductor contraction, thereby emphasizing the inner thigh, groin, pelvic wall, and entire abdominal cavity.

The apparatus of the invention can be used to accomplish a horizontal supine position and varying degrees of load by altering the height and tilt of support platform swinging, depending upon the needs of the patient for muscular contraction and work load required while emphasizing adductor contraction. An adjustable frame is provided and allows for height and load variability, from 0 degrees to 45 degrees, therefore creating quadriceps and iliopsoas stretch, as well as adductor and rectus abdominal contraction. Means associated with the platform or platforms or seat induces contraction of the user's thighs relatively toward one another in response to the trunk pivoting, for producing anterior rotation of the user's ilium, thereby inducing distraction of the user's sacroiliac joint, at the ilium posterior. The apparatus can be angularly adjusted in order to vary the angle of the foreleg, thigh, hip, pelvic, and spinal musculature, thereby increasing or decreasing work load, isokinetic contraction, and resistance. These techniques are beneficial to those suffering from the aforementioned maladies and are believed unique as respects multiple angles and contour formation of the novel apparatus.

Basically, the apparatus of the invention comprises a) primary support means, including a primary platform to support a user's legs, and to allow pivoting of the user's trunk about a generally horizontal axis as the user relatively bends his body and/or his or her legs, b) and auxiliary support means connected to the primary support means, and projecting relatively away form the primary platform at adjusted level and to an extent to support at least one of the following:

i) the user's trunk between the head and legs, ii) the user's legs between the feet and knee.

As will be seen, the auxiliary support means may include one or two pivotable platforms connected to the primary support means, as well as adjustable supports for those platforms. The primary platform may have saddle means to support the user's thighs.

The apparatus has the additional function of serving as a patient examination table.

The method of the invention includes:

a) supporting the patient on platform means, and at the patient's thighs, as well as at forward and rearward body locations, b) then controllably lowering at least one of those forward and rearward locations variably to tension the patient's spinal region.

These locations may comprise support tables undergoing variable tilt, and relative to a thigh aligning, saddle-shaped, primary support pad. Supports for the platform means may be adjusted manually, or by motor drives, which may be operated to tiltably oscillate two platforms, or either of them.

These and other objects and advantages of the invention, as well as the details of an illustrative embodiment, will be more fully understood from the following specification and drawings, in which:

DRAWING DESCRIPTION

FIG. 1 is a side elevation showing one form of apparatus embodying the invention;

FIG. 2 a plan view showing a pivotal connection between elements of FIG. 1;

DETAILED DESCRIPTION

Figure 1:
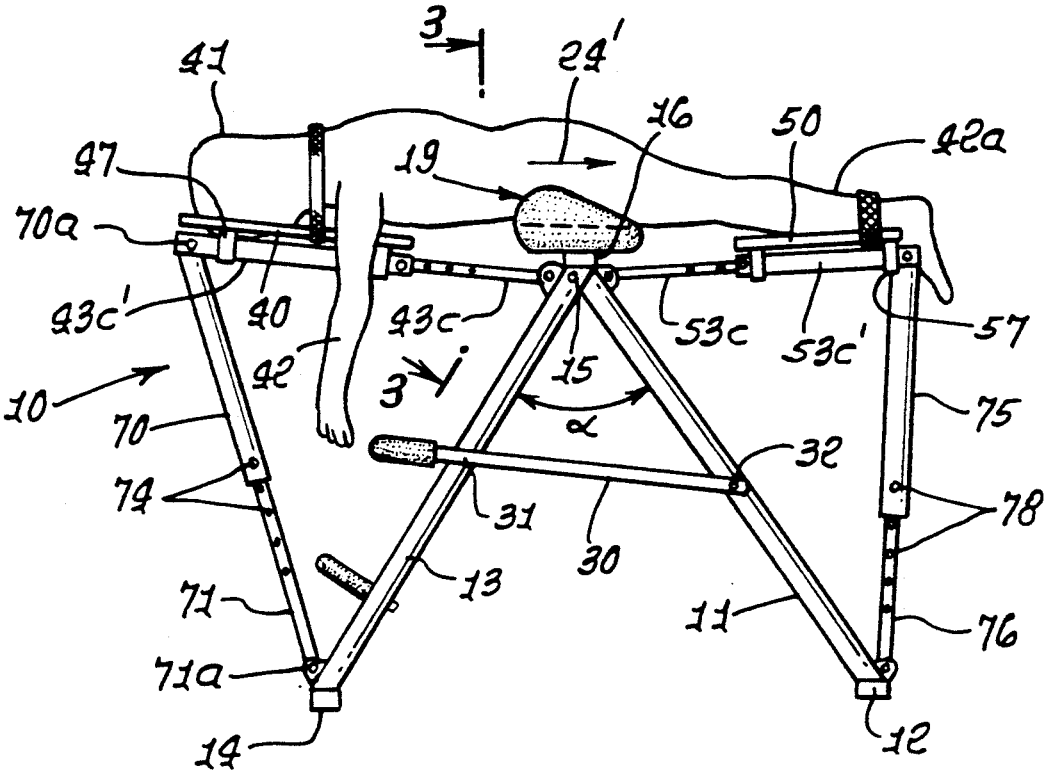
Figure 2:
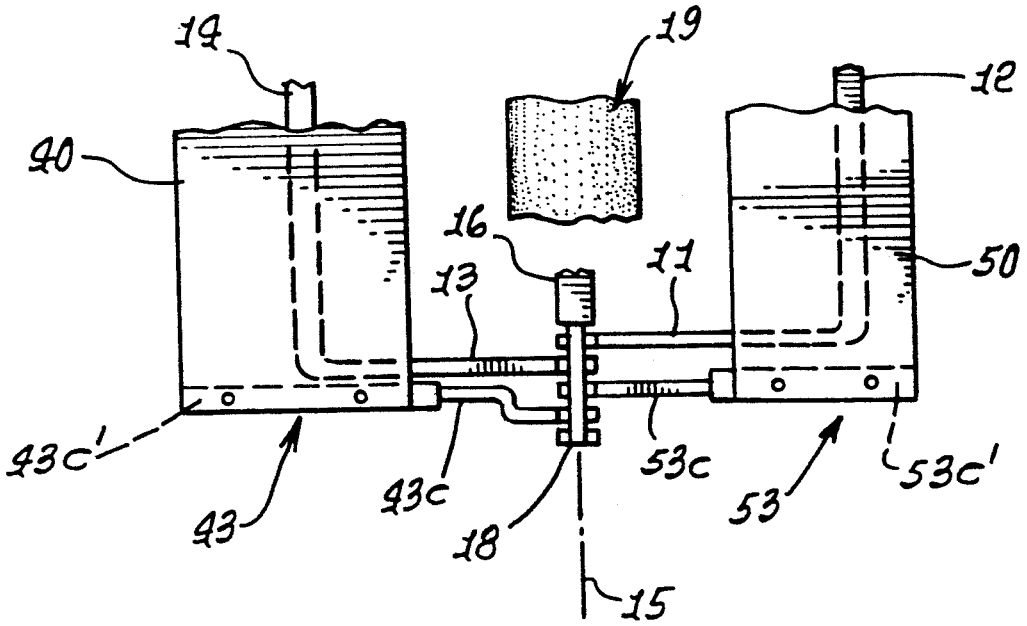
Figure 3:
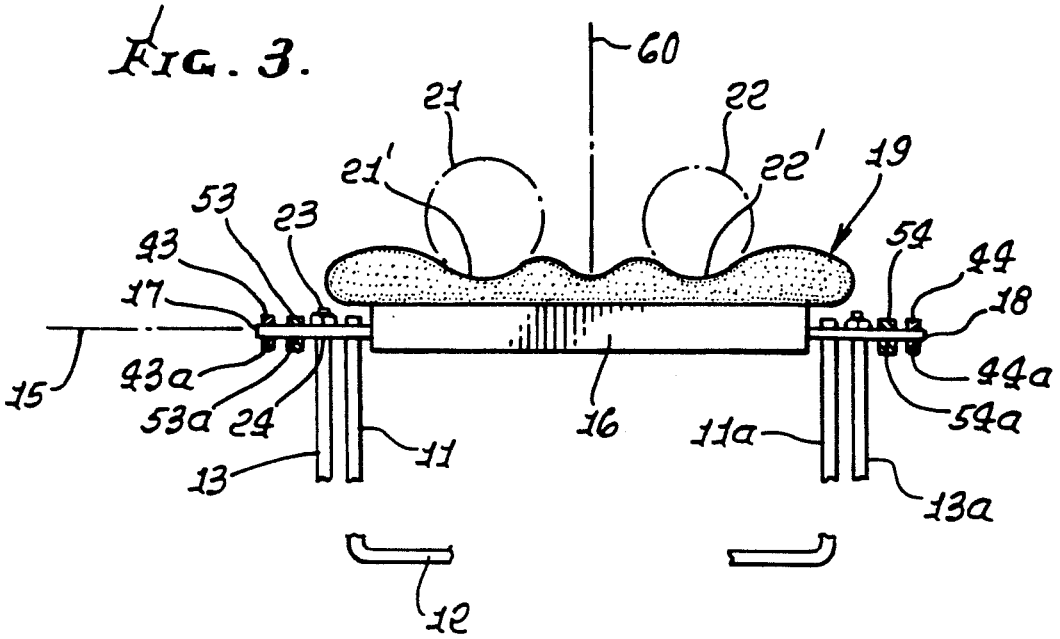
FIG. 3 is a fragmentary elevation taken on lines 3—3 of FIG. 1.
Figure 4:
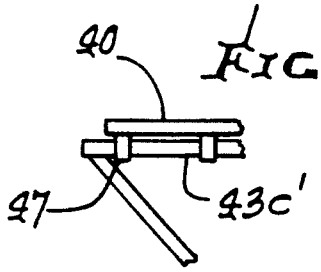
FIG. 4 is a fragmentary side elevation showing support of a therapy board.

In FIGS. 1–4, the illustrated body supporting and flexing apparatus 10 includes primary support means in the form of a first pair of leg members 11 and 11*a* joined by a cross member 12, and a second pair of leg members 13 and 13*a* joined by a cross member 14. Structure is provided at the upper ends of the leg members to interconnect them to relatively pivot about a common transverse axis 15. See FIG. 2. One form of such structure includes a pad support plate 16 that extends transversely, and two trunnions or axles 17 and 18 projecting at opposite ends of the plate 16. Leg members 11 and 13 are pivotally connected to axle 17, and leg members 11*a* and 13*a* are pivotally connected to axle 18.

A body thigh support platform or pad 19 is mounted on plate 16, and to support a user's thighs 21 and 22, whereby the pad is pivotable about axis 15. Alternatively, the pad may be carried by a hinge part pivotally connected to a second hinge part attached to 16. The axles and platforms may be locked in position, as by lock means, such as an adjustable key or keys 23 bearing on an axle, as at bearing 24. The platform 19 provides upper thigh support regions 21' and 22', which are downwardly concave throughout their lengths, in a length direction indicated by arrow 24' in FIG. 1. Thus, the user's main weight, exerted via upper thighs, is borne by the platform and its leg members.

The leg members 11 and 11*a* may be pivotally spread apart relative to leg members 13 and 13*a*, as in FIG. 1, and at angle $\alpha$ to provide platform support. A link 30 interconnects leg members 11 and 13, below the level of axis 15, to control the degree of spreading of the members. See pin connections 31 and 32 between 30 and leg members 11 and 13. A handle 30*a* is provided on a forwardly protruding portion of the link, to be grasped by hand 33*a* of the user 33. A similar link 30 and handle 32 may be employed in connecting association with legs 11*a* and 13*a*.

In accordance with the invention, auxiliary support means is connected to the primary support means, and projects relatively away form the primary platform at adjusted level and to an extent to support at least one of the following:

i) the user's trunk between the head and legs, ii) the user's legs between the feet and knee.

As shown, the auxiliary support means has operative pivotal connection to the primary support means. See for example the first auxiliary support platform or table 40 projecting forwardly away from the pad or thigh platform 19, to support the user's head 41, with the user's arms 42 hanging downwardly at opposite sides of the first platform 40. Pivotal support for platform 40 is provided by struts 43 and 44 pivoted to and extending from the platform opposite side axles 17 and 18. See FIG. 3 pivotal bearings 43*a* and 44*a*. Other type pivots may be employed. Also shown is a second auxiliary platform or table 50 projecting rearwardly away from thigh platform 19 to support the user's lower legs 42*a*, as between the knees and feet. Pivotal support for platform 50 is provided by struts 53 and 54 extending from the platform opposite sides to axles 17 and 18. See bearings 53*a* and 54*a*. Alternatively, the struts can be hinged to the legs 11, 13, 11*a*, and 13*a*.

Figure 5:
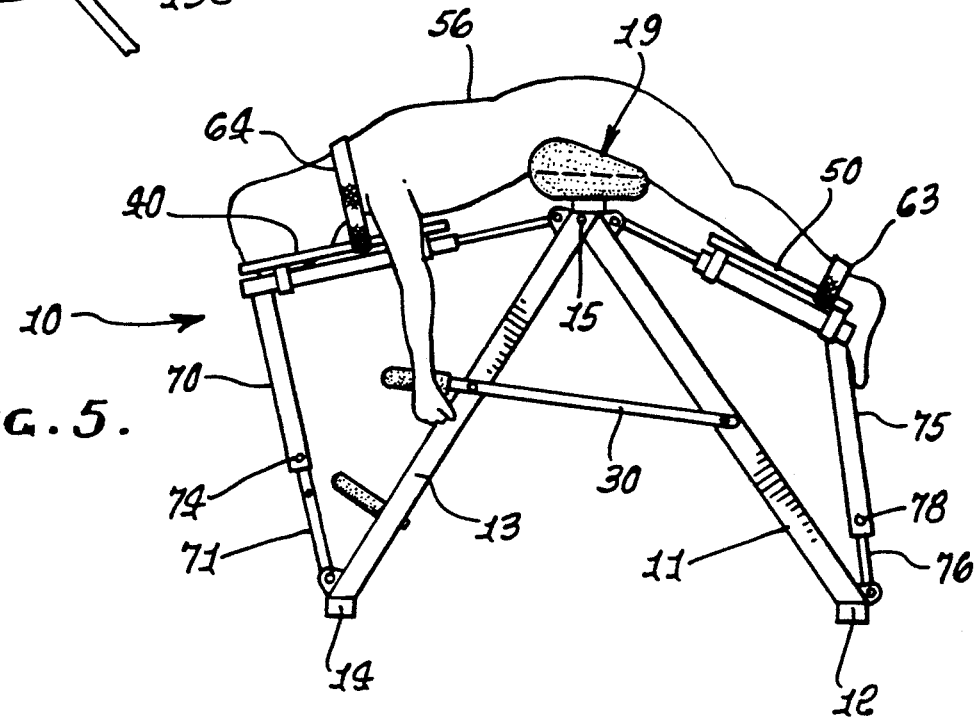
FIG. 5 is a side elevation like FIG. 1 showing the apparatus in one position of pivoting.

The two auxiliary platforms 40 and 50 can be selectively, individually and relatively tilted (as by pivoting about the axis 15), as is clear from FIG. 5. Thus, the user's body, and in particular his spinal region 56 can be controllably tensioned or stretched, as by controllably tilting his torso, or his legs, while he rests comfortably on the platforms 40 and 50, and on the pad 19. The cup-shaped surfaces of the latter hold his thighs (and spine) correctly aligned in a vertical plane 60, during such tilt-controlled and adjustable tensioning. Either or both of the platforms 40 and 50 may be controllably tilted. Retention bands 63 and 64 may be applied to the user's feet, and to his neck region, and attached to tables 40 and 50, to hold or retain the user in position, lengthwise and laterally.

The auxiliary support means may also include a first adjustable elongated support structure extending beneath the first auxiliary platform in load supporting relation therewith, and having connection to the primary support means below the level of the primary platform; and also, the auxiliary support means may include a second adjustable elongated support structure extending beneath the second auxiliary platform in load supporting relation therewith, and having connection to the primary support means below the level of the primary platform. See for example the relatively telescopically interconnected members 70 and 71, laterally spaced left and right members 70 pivotally connected at 70*a* to the struts 43 and 44 or to platform 40; and members 71 pivotally connected to the lower ends of legs 13 and 13*a*, as at 71*a*. Pairs of telescoping members 70 and 71 may be adjustably interconnected at registering hole and pin connections 74 spaced along the member lengths. See also, for example, the relatively telescopically interconnected members 75 and 76, left and right members 75 pivotally connected at 75*a* to strut members 53 and 54, or to platform 50; and left and right members 76 pivotally connected to the lower ends of legs 11 and 11*a*, as at 76*a*. See also hole and pin connections 78 spaced along the lengths of members 75 and 76.

Struts 43 and 44 may be provided as telescoping struts with adjustable sections 43*c* and 43*c'*, and 44*c* and 44*c'*, as in FIG. 1. Board or platform 40 is supported at 47 on strut section 43*c'* and 44*c'*. Struts 53 and 54 may likewise be provided as telescoping struts, with adjustable sections 53*c* and 53*c'* and 54*c'*, as in FIG. 1. Board or platform 50 is supported at 57 on sections 53*c*.

Bottom supports 12 and 14 support the lower ends of the leg members 11, 11*a*, 13, and 13*a*, as shown.

Figure 6:
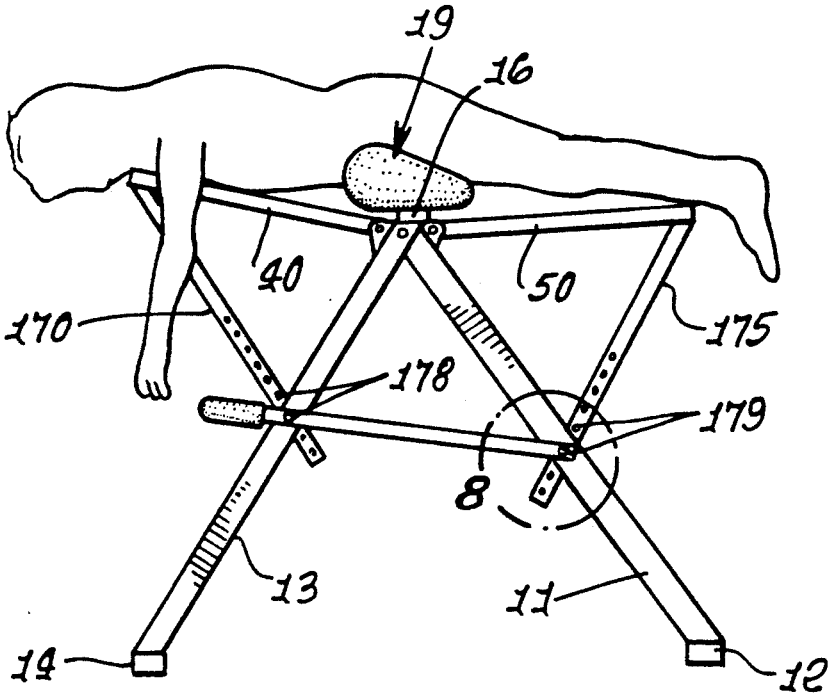
FIG. 6 is a view like FIG. 1 showing modified apparatus.
Figure 7:
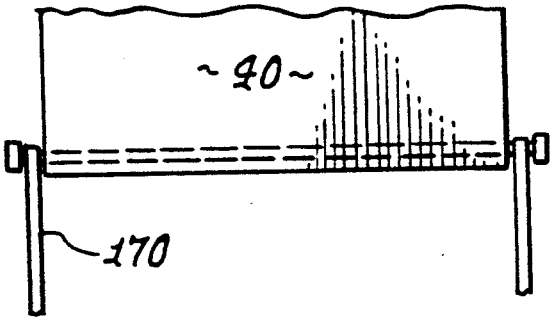
FIG. 7 is a fragmentary plan view showing a pivotal connection between elements of FIG. 5.
Figure 8:
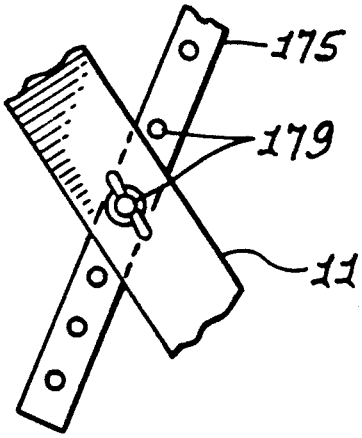
FIG. 8 is a fragmentary elevation taken on lines 8—8 of FIG. 1.

FIGS. 6–8 show a modified form of the apparatus. The elements are the same as in FIGS. 1–4, with the following changes: platforms 40 and 50 themselves are directly hinge connected to the axles 17 and 18, so are not lengthwise adjustable. Also, laterally spaced support elements 170 (corresponding to 70) are not lengthwise telescopically adjustable but have selectable pin and hole connections (see 178) to legs 13 and 13*a*; and laterally spaced support elements 175 (corresponding to 75) are not lengthwise telescopically adjustable but have selectable pin and hole connections (see 179) to legs 11 and 11*a*.

I claim:

1. Body supporting and flexing apparatus, comprising:

a) primary support means, including a primary platform to support a user's legs, and to allow pivoting of the user's trunk about a generally horizontal axis as the user relatively bends his body and his legs, b) and auxiliary support means connected to said primary support means, and projecting relatively away from said primary platform at adjusted level and to an extent to support at least one of the following:

i) the user's trunk between the head and legs, ii) the user's legs between the feet and knees, c) said primary platform including thigh saddle means located generally above said pivotal connection, said thigh saddle means having two sidewardly spaced, upwardly presented, thigh support regions, said regions being downwardly concave throughout substantially their lengths, said saddle means projecting upwardly between said concave regions, whereby positioning and alignment of the user's thighs and spine are controlled during said trunk pivoting, d) said auxiliary support means including a first auxiliary support platform projecting forwardly away from said primary platform at a selected adjusted level, and having pivoted connection to said primary support means, allowing selected relative tilting of said first auxiliary platform, e) said auxiliary support means also including a second auxiliary support platform projecting rearwardly away from said primary platform at a selected adjustment level, and having pivoted connection to said primary support means, allowing selective relative tilting of said second auxiliary platform.

2. The combination of claim 1 wherein said primary support means includes structure defining a transverse horizontal axis about which both said first and second auxiliary platforms are individually and selectively tiltable.

3. The combination of claim 1 wherein said auxiliary support means includes a first adjustable elongated support structure extending beneath said first auxiliary platform in load supporting relation therewith, and having connection to said primary support means below the level of said primary platform.

4. The combination of claim 3 wherein said auxiliary support means includes a second adjustable elongated support structure extending beneath said second auxiliary platform in load supporting relation therewith, and having connection to said primary support means below the level of said primary platform.

5. The combination of claim 3 wherein said first adjustable elongated support structure includes relatively telescopically interconnected members.

6. The combination of claim 4 wherein said first and second adjustable elongated support structures includes relatively telescopically interconnected members in at least two pairs.

7. The combination of claim 1 wherein said primary support means includes upwardly converging support members having upper extents pivotally supporting said first and second auxiliary platforms generally below the level of said saddle concave regions whereby the user's trunk and thighs are spaced above said platforms at locations near said saddle means so that said saddle means controls trunk and thigh alignment during trunk pivoting.

* * * * *